US010091597B2

(12) United States Patent
Termeulen et al.

(10) Patent No.: US 10,091,597 B2
(45) **Date of Patent: *Oct. 2, 2018**

(54) OFF-HEAD DETECTION OF IN-EAR HEADSET

(71) Applicant: Bose Corporation, Framingham, MA (US)

(72) Inventors: Ryan Termeulen, Watertown, MA (US); Jahn Dmitri Eichfeld, Natick, MA (US); Fernando Mier, Chicago, IL (US); Andrew Sabin, Chicago, IL (US)

(73) Assignee: BOSE CORPORATION, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/869,269

(22) Filed: Jan. 12, 2018

(65) Prior Publication Data

US 2018/0249265 A1 Aug. 30, 2018

Related U.S. Application Data

(63) Continuation of application No. 15/478,681, filed on Apr. 4, 2017, now Pat. No. 9,894,452.

(60) Provisional application No. 62/463,202, filed on Feb. 24, 2017.

(51) Int. Cl.
*H04R 29/00* (2006.01)
*H04R 1/10* (2006.01)

(52) U.S. Cl.
CPC ..... *H04R 29/001* (2013.01); *H04R 1/1041* (2013.01); *H04R 1/1016* (2013.01); *H04R 2460/01* (2013.01); *H04R 2460/03* (2013.01)

(58) Field of Classification Search
CPC ..... H04R 29/00
See application file for complete search history.

(56) References Cited

U.S. PATENT DOCUMENTS

| | | | |
|---|---|---|---|
| 6,542,436 | B1 | 4/2003 | Myllyla |
| 6,704,428 | B1 | 3/2004 | Wurtz |
| 7,031,460 | B1 | 4/2006 | Zheng et al. |

(Continued)

FOREIGN PATENT DOCUMENTS

| | | | |
|---|---|---|---|
| EP | 2613566 | A1 | 7/2013 |
| EP | 2415276 | B1 | 8/2015 |
| EP | 2680608 | B1 | 2/2016 |

OTHER PUBLICATIONS

Non-Final Office Action in U.S. Appl. No. 15/478,681 dated Aug. 3, 2017; 8 pages.

(Continued)

*Primary Examiner* — Olisa Anwah
(74) *Attorney, Agent, or Firm* — Schmeiser, Olsen & Watts LLP

(57) ABSTRACT

An off-head detection system for an in-ear headset comprises an input device that receives an audio signal, a feed-forward microphone signal, and a driver output signal; an expected-output computation circuit that predicts a value of the driver output signal based on a combination of the audio signal and the feed-forward microphone signal from the signal monitoring circuit, and off-head data from the off-head model; and a comparison circuit that compares the observed output signal provided to the driver and the computed expected output to determine an off-head state of the in-ear headset.

18 Claims, 10 Drawing Sheets

(56) References Cited

U.S. PATENT DOCUMENTS

| | | | | |
|---|---|---|---|---|
| 8,098,838 | B2 | 1/2012 | Lee et al. | |
| 8,155,334 | B2 * | 4/2012 | Joho | G10K 11/178 381/71.12 |
| 8,238,567 | B2 | 8/2012 | Burge et al. | |
| 8,238,570 | B2 | 8/2012 | Johnson, Jr. et al. | |
| 8,238,590 | B2 | 8/2012 | Burge | |
| 8,243,946 | B2 | 8/2012 | Burge et al. | |
| 8,416,961 | B2 | 4/2013 | Lee et al. | |
| 8,675,885 | B2 | 3/2014 | Sapiejewski | |
| 8,699,719 | B2 | 4/2014 | Johnson, Jr. et al. | |
| 8,705,784 | B2 | 4/2014 | Haartsen et al. | |
| 8,831,239 | B2 | 9/2014 | Bakalos | |
| 8,842,848 | B2 | 9/2014 | Donaldson et al. | |
| 8,965,012 | B1 * | 2/2015 | Dong | H04R 1/028 381/151 |
| 9,232,308 | B2 | 1/2016 | Murata et al. | |
| 9,560,451 | B2 | 1/2017 | Eichfeld et al. | |
| 9,654,854 | B2 | 5/2017 | Darlington et al. | |
| 2009/0003641 | A1 | 1/2009 | Van Der Bilt | |
| 2010/0177917 | A1 | 7/2010 | Van Der Werf | |
| 2010/0246847 | A1 | 9/2010 | Johnson, Jr. et al. | |
| 2011/0038496 | A1 | 2/2011 | Lott et al. | |
| 2011/0188685 | A1 | 8/2011 | Sheikh | |
| 2013/0121494 | A1 | 5/2013 | Johnston | |
| 2013/0148820 | A1 | 6/2013 | Sagong et al. | |
| 2014/0126734 | A1 | 5/2014 | Gauger et al. | |
| 2014/0146976 | A1 | 5/2014 | Rundle | |
| 2016/0372102 | A1 | 12/2016 | Liu et al. | |
| 2017/0013345 | A1 | 1/2017 | Kumar et al. | |
| 2017/0053639 | A1 | 2/2017 | Lu et al. | |
| 2017/0125006 | A1 | 5/2017 | Dzhigan et al. | |
| 2017/0127171 | A1 | 5/2017 | Haworth | |
| 2017/0127194 | A1 * | 5/2017 | Neumeyer | H04R 25/505 |
| 2017/0148428 | A1 | 5/2017 | Thuy et al. | |
| 2017/0180840 | A1 | 6/2017 | Yamkovoy | |
| 2017/0180879 | A1 * | 6/2017 | Petersen | H04R 25/305 |
| 2017/0193975 | A1 | 7/2017 | Butts | |
| 2017/0193978 | A1 | 7/2017 | Goldman | |
| 2017/0193979 | A1 | 7/2017 | Benway et al. | |
| 2017/0195776 | A1 | 7/2017 | Reimert | |
| 2017/0195802 | A1 | 7/2017 | Eichfeld | |
| 2017/0332180 | A1 | 11/2017 | Fretz | |

OTHER PUBLICATIONS

Notice of Allowance in U.S. Appl. No. 15/478,681 dated Oct. 11, 2017; 6 pages.

Non-Final Office Action for U.S. Appl. No. 15/869,281, dated Mar. 30, 2018.

International Search Report and Written Opinion in International Patent Application No. PCT/US2018/013441, dated Jun. 6, 2018; 20 pages.

Notice of Allowance in U.S. Appl. No. 15/869,281 dated Aug. 1, 2018; 6 pages.

* cited by examiner

If In-Ear Detection Is ON

If user tries to deactivate In-Ear Detection

If In-Ear Detection Is OFF

OFF-HEAD DETECTION OF IN-EAR HEADSET

RELATED APPLICATIONS

This application is a continuation application of U.S. Non-Provisional patent application Ser. No. 15/478,681, filed Apr. 4, 2017, entitled "Off-Head Detection of In-Ear Headset," which in turn claims the benefit of U.S. Provisional Patent Application Ser. No. 62/463,202, filed Feb. 24, 2017 entitled "Off-Head Detection of In-Ear Headset", the contents of each of which are incorporated herein in its entirety.

BACKGROUND

This description relates generally to in-ear listening devices, and more specifically, to systems and methods for off-head detection of an in-ear listening device

BRIEF SUMMARY

In accordance with one aspect, an off-head detection system for an in-ear headset, comprises an input device that receives an audio signal, a feed-forward microphone signal, and a driver output signal; an expected-output computation circuit that predicts a value of the driver output signal based on a combination of the audio signal, the feed-forward microphone signal, and off-head data; and a comparison circuit that compares the observed output signal provided to the driver and the computed expected output to determine an off-head state of the in-ear headset.

Aspects may include one or more of the following features.

The input device may include an active noise reduction (ANR) circuit that processes the feedback microphone signals.

The input device may include an active noise reduction (ANR) circuit that processes both the feedback feed-forward microphone signals.

At least the comparison circuit is constructed and arranged may be part of a digital signal processor (DSP) that compares the driver output signal, the audio signal, and the feedback and feed-forward microphone signals to determine the off-head state of the in-ear headset.

The off-head detection system may further comprise a signal monitoring circuit that measures the feed-forward microphone signal and audio signal.

The off-head detection system may further comprise a signal monitoring circuit that measures the feed-forward microphone signal and audio signal.

The off-head detection system may further comprise an off-head model that processes off-head data produced according to acoustic transfer functions that change in magnitude when the device is removed from the ear.

The expected-output computation circuit may predict the value of the driver output signal based on a combination of the audio signal and the feed-forward microphone signal from the signal monitoring circuit and the off-head data from the off-head model, and a result of the comparison may confirm that the predicted driver signal is similar to a measured signal, then an off-head state is confirmed.

In another aspect, a method for performing a fit quality assessment, comprises detecting an off-head state when an earbud is donned; executing an off-head detection system; and displaying informational feedback regarding the off-head state.

Aspects may include one or more of the following features.

Executing the off-head detection system may comprise receiving by an input device an audio signal, a feed-forward microphone signal, and a driver output signal; predicting by an expected-output computation circuit a value of the driver output signal based on a combination of the audio signal, the feed-forward microphone signal, and off-head data; and comparing by a comparison circuit the observed output signal provided to the driver and the computed expected output to determine an off-head state of the in-ear headset.

The method may further comprise measuring by a signal monitoring circuit the feed-forward microphone signal and audio signal.

The method may further comprise processing by an off-head model off-head data produced according to acoustic transfer functions that change in magnitude when the device is removed from the ear.

The method may further comprise predicting the value of the driver output signal based on a combination of the audio signal and the feed-forward microphone signal from the signal monitoring circuit and the off-head data from the off-head model, wherein when a result of the comparison confirms that the predicted driver signal is similar to a measured signal, then an off-head state is confirmed.

In another aspect, a control system for a listening device comprises a detection system that reconfigures parameters in response to a detection event; and an active noise reduction (ANR) circuit that manages at least a feedback-based noise reduction function.

Aspects may include one or more of the following features.

The control system may further comprise a hearing assistance system that combines a gain with the audio signal and outputs modified audio signal to the ANR circuit.

The control system may further comprise a gain reduction system that reduces oscillation when the listening device is removed from an ear.

In another aspect, a method for off-head detection, comprises performing signal processing on a feedforward microphone signal and an input audio signal to determine an estimated discrete transform of a driver output signal; determining an actual discrete transform of the driver output signal; and comparing the actual discrete transform and the estimated discrete transform; and determining an off-head state when the actual discrete transform and the estimated discrete transform are determined to be sufficiently similar.

Aspects may include one or more of the following features.

A discrete Fourier transform (DFT) may be calculated for each of the driver output signal, feed-forward microphone signal, and audio signal at select frequencies where a feedback ANR loop is active.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
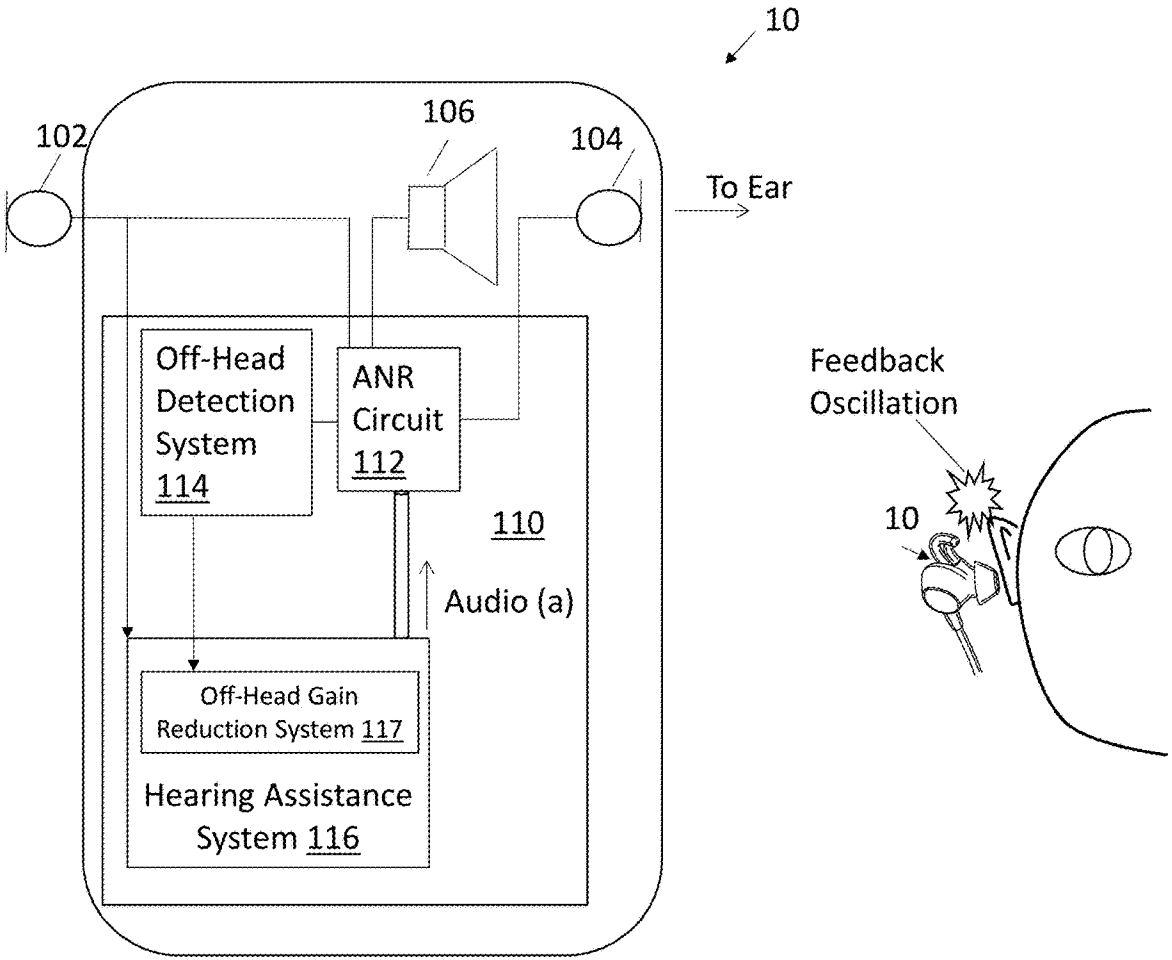
FIG. 1 is a block diagram of an in-ear listening device and a schematic view of an environment in which the in-ear listening device operates, in accordance with some examples.

Listening devices for hearing-impaired users principally increase the level of desired ambient sound. However, such devices are susceptible to instability driven by the gain of the listening device and due to the placement of the external microphone relative to the headset driver, and the presence of an acoustic transfer path between the driver and the external microphones. The acoustic transfer path is characterized by a transfer function from the loudspeaker to the microphone from which the amplified signal is derived. This transfer function increases in magnitude during earbud insertion of the listening device into the ear, removal of the listening device from the ear, or when the listening device is completely off-head in a standalone environment, any of which may result in undesirable feedback oscillation at frequencies where the acoustic transfer path is relatively efficient. In contrast, when the earbud is properly inserted in the ear, a baffle is formed between the loudspeaker and microphone, decreasing the magnitude of the driver-to-microphone transfer function and therefore preventing or mitigating oscillation. Note that the feedback being discussed herein refers to an undesired positive external feedback loop between the headset output and a feed-forward microphone, not intentional negative feedback using an internal microphone for noise reduction purposes.

A feedback cancellation algorithm may be provided to avoid oscillation, but typically adds only about 10 dB of stable gain, and is not effective for the entire range of a selectable gain. As a result, when the device is removed from the ear, i.e., is off-head, and when the device is being put on or removed, donned, or doffed, little can be done to avoid undesirable oscillation from occurring, other than reducing the gain.

Accordingly, systems and methods according to some examples can reduce undesirable oscillation by reducing the gain automatically.

To avoid prolonged undesirable feedback oscillation between the headset driver and external microphones when the headset is not properly inserted in the ear, examples of an off-head detection system and method are disclosed. In these examples, when an off-head state is detected, the gain is automatically reduced until after the earbud is reinserted in the ear. Because prolonged oscillation of the system is not desirable, the off-head detection system in accordance with some examples is configured to recognize earbud removal, for example, in about 0.25 seconds after removal, and to fully reduce the device gain in about 1 second after removal.

Uses of off-head detection beyond oscillation mitigation may include data collection to determine whether the device is not being worn and auto-shutoff of the device if it is off-head for a prolonged period of time. For these uses, an algorithm may be implemented as part of the off-head detection system and method that monitors a system for anomalies or extreme cases in a range between an acceptable fit of the headphone positioned in the wearer's ear and a poor fit where the earbud does not properly seal the ear canal. For these uses, the algorithm must be reliable at all gain levels, but reaction time is not as important. Additional, non-oscillation related uses of off-head detection include but are not limited to: 1) To detect when a device is no longer in use and should then be powered down or placed into a low power state to save battery; 2) To reconfigure the performance of the device such as a binaural microphone array for example, U.S. Pat. No. 9,560,451, granted January 31, the contents of which are incorporated herein by reference in their entirety, when only one ear is donned; 3) To extract usage data pertaining to how many ears are donned and in what situations; and/or 4) To provide feedback to users via a user interface on the on/off-head state of earbud so as to enable the user to detect and correct a very poor earbud fit.

As shown in FIG. 1, an in-ear listening device 10 includes a feed-forward microphone 102 and feedback microphone 104 that sense sounds at a wearer's ear, a processor 110, or controller, that enhances the sounds, and an acoustic driver 106 that outputs the enhanced sounds to the wearer's ear canal. The controller 110 of the in-ear listening device 10 includes active noise reduction (ANR) circuitry 112 for managing the feedback- and feed-forward-based noise reduction functions. In these examples, feedback ANR is required and feed-forward ANR is optional.

The controller 110 includes an off-head detection system 14 that is constructed and arranged to detect when the device 10 is removed from the wearer's ear. In some examples, the off-head detection system 114 performs signal processing, wherein discrete transforms of one or more signals read from the ANR circuit 112 are computed. The controller 110 may also include a hearing assistance system 116 which executes various functions, for example, manual or automatic gain control, compression, filtering, and so on. Once an off-head detection system 114 is constructed, a complementary off-head gain reduction system 117 can be constructed and arranged within the hearing assistance system 116 in order to reduce oscillation when the device is removed from the ear. While the controller 110 is shown as a component of the in-ear listening device 10, in some examples, the controller and related electronics are remote from the in-ear component, and connected to the in-ear component by a cable or wirelessly. Also, in some examples, the off-head detection system 114 can operate without the hearing assistance system 116 and/or gain reduction system 117.

Both feedback and feed-forward ANR may be used by the in-ear listening device 10, although as previously mentioned, feedback ANR is required. In particular, the closed loop frequency response of the feedback ANR system must be measurably different in the on-head and off-head states. In this example, feed-forward ANR is optional.

The in-ear listening device 10 may be wired or wireless for connecting to other devices. The in-ear listening device 10 may have a physical configuration permitting the device to be worn in the vicinity of either one or both ears of a user, including and not limited to headphones with either one or two earpieces, over-the-head headphones, behind-the-neck headphones, headsets with communications microphones (e.g., boom microphones), wireless headsets, single earphones or pairs of earphones, as well as hats or helmets incorporating earpieces to enable audio communication and/or to enable ear protection. Still other implementations of personal acoustic devices may include, for example, eyeglasses with integral electro-acoustic circuitry including the in-ear listening device 10 to which what is disclosed and what is claimed herein is applicable will be apparent to those skilled in the art.

In some examples, in-ear headsets may include an earbud for each ear. Here, an off head detection system 14 can operate independently at each earbud. In some examples, an earbud operates using information from the other earbud to improve detection.

In operation, the feed-forward microphone 102 detects sound from an external acoustic source. The ANR circuit 110 generates anti-noise, or negative pressure signal or the like to cancel the detected sound based on the expected passive transfer function of sound past the earbud into the ear, and provides the anti-noise to the acoustic driver 106. The feedback microphone 104 is positioned in front of the acoustic driver 106, or more specifically, in a shared acoustic volume with the acoustic driver 106 and the ear drum of the wearer when worn, so that it detects sound in a similar manner as the wearer's natural hearing function. The feedback microphone 104 also detects the sound from the acoustic source, to whatever extent it penetrates the earbud; the ANR circuit 112 processes the sound and creates an anti-noise signal that is sent to the acoustic driver 106 to cancel the ambient noise. The presence of both microphones 102, 104 permits the ANR circuit 112 to suppress noise at a broader range of frequencies, and to be less sensitive to fit (e.g. how a user wears the headset) than with only one. In some examples, the ANR circuit 112 may provide both feedback-based ANR and feed-forward-based ANR. However, in other examples, both microphones are not necessary, more specifically, the feed-forward ANR function enabled by the feed-forward microphone 102 is not required. In this example, the feed-forward microphone 102 provides the signal to be amplified, so without it, there is no instability to address in the gain reduction system. Additionally, the feed-forward microphone 102 is used as an input to the off-head detection system 114. The loudspeaker output signal is also used as an input to the off-head detection system 114, but it could not provide this function without the feedback-based ANR that uses the feedback microphone 104.

Referring again to the off-head detection system 114, in some examples, the off-head detection system 114 is implemented in a special-purpose processor for example, including a digital signal processor (DSP), that compares the output signal (d) provided to the driver, the input audio signal (a), and the outputs (s, o) of the microphones 102, 104, respectively, to determine an off-head state of the in-ear headset. In other examples, the off-head detection system 114 is implemented as additional processing within a DSP providing the ANR circuit 112, or in a general purpose microprocessor, such as may be part of a wireless communication subsystem.

Figure 2:
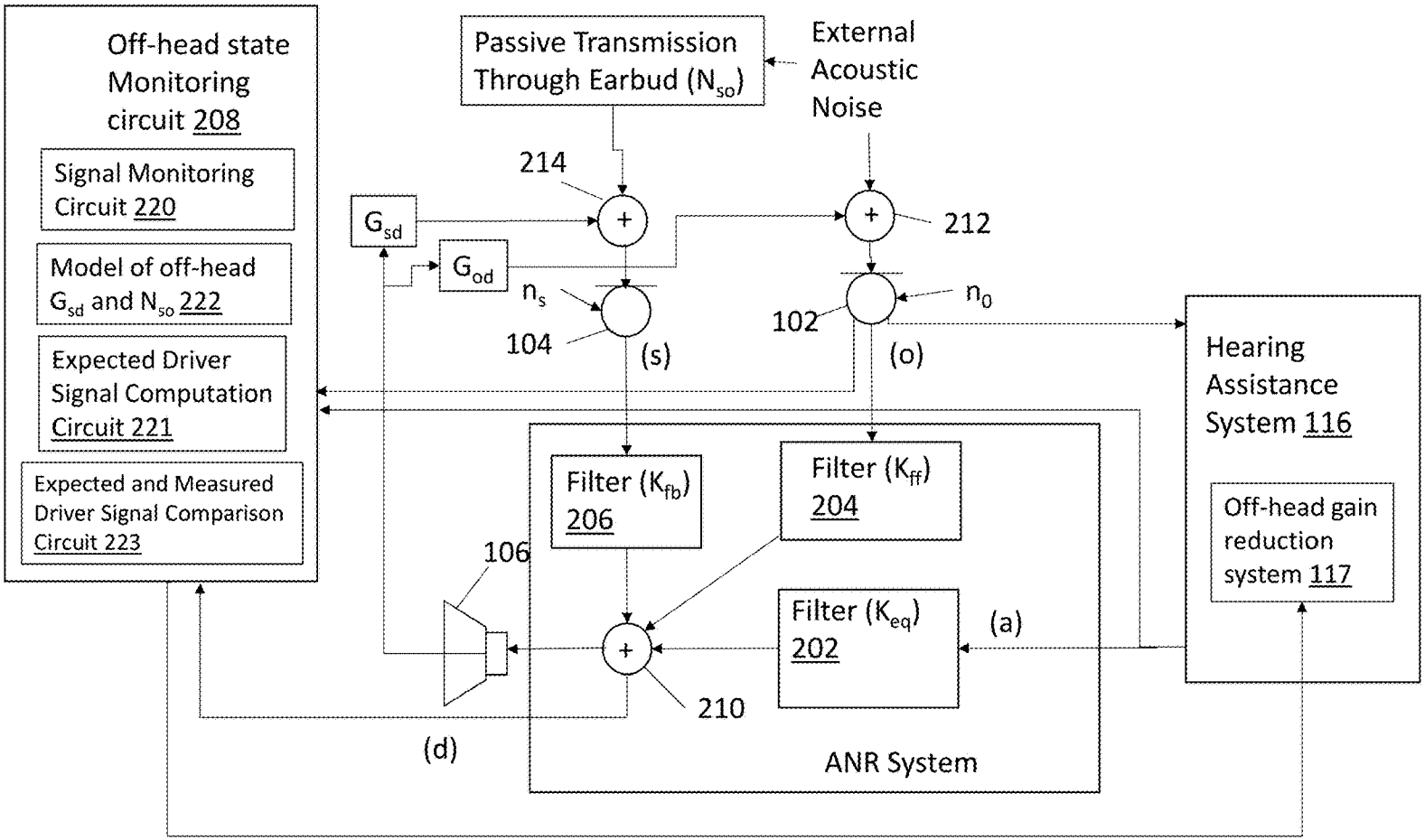
FIG. 2 is a signal flow diagram of an architecture that includes an off-head detection system of a listening device, in accordance with some examples.

FIG. 2 is a signal flow diagram of an architecture that includes the off-head detection system 114 of FIG. 1, in accordance with some examples. The off-head detection system 114 of FIG. 1 may be constructed and arranged as an off-head monitoring circuit 208 that detects when the device 10 is taken off-head by comparing the current state of the system with the expected state of the system in an off-head state. Some or all of the off-head monitoring circuit 208 may be part of a DSP or the like. An output of the off-head monitoring circuit 208 may be provided to the off-head gain reduction system 117. The filters, summing amplifiers, and other elements are implemented in hardware of the controller 110, which may be hard-wired or configured by software. In some examples, the ANR system in FIG. 2 executes at one processor, and the other elements of FIG. 2, for example, hearing assistance system 116, off-head-gain reduction system 117, and off-head state monitoring circuit 208 execute at another processor.

Transfer functions noted as $G_{ij}$ refer to physical transfer functions from an input signal "j" to an output signal "i". For example, $G_{sd}$ refers to the physical transfer function from voltage applied to the driver 106 to the voltage measured at the feedback microphone 104, or system microphone.

The ANR system including digital filters 202, 204, 206 receives an input signal, such as an audio signal (a). The audio signal (a) may include voice, music, or other sound-related streamed audio. The audio signal (a) may also include external sound processed by the hearing assistance system. The audio signal (a) is passed through a first digital filter 202, which is represented by a known transfer function ($K_{eq}$). The purpose of the first digital filter 202 is to equalize an audio (a) stream input so that it sounds appropriate (as heard by the wearer) at the eardrum, given the acoustical properties of the earbud system and the properties of the feedback ANR loop. In doing so, the equalized audio stream is output to a summing amplifier 210.

Also received at the first summing amplifier 210 is an output from a second digital filter 204, which is represented by a known transfer function ($K_{ff}$) for processing and filtering sound measured at the feed-forward microphone 102, and an output from a third digital filter 206, which is represented by a known transfer function ($K_{fb}$) for processing and filtering sound measured at the feedback microphone 104. Transfer functions $K_{ff}$ and $K_{fb}$ provide feedback and feed-forward ANR (respectively) in the in-ear listening device. The signal (o) picked up by the feed-forward microphone 102 may include a combination of external sound and uncorrelated noise ($n_o$). The noise ($n_o$) may include electrical sensor noise produced by the microphone 102, acoustical wind noise, or acoustical noise generated by objects rubbing up against the earbud.

The signal (s) picked up by the feedback microphone 104 may include a combination of external sound that remains after any passive attenuation provided by the earbud, any sound produced by the driver 106, and uncorrelated noise ($n_s$). The noise ($n_s$) may include electrical sensor noise produced by the microphone 104 and acoustical noise generated by tapping on the earbud. The driver output and the other acoustical sources are summed acoustically in the volume of space around the microphone, represented as addition element 214. When the earbud is removed from the head, or is in-place in the ear but not well-sealed (i.e., referred to as leaking), sound from the driver 106 can also reach the feed-forward microphone 102, as shown by addition element 212, with transfer function $G_{od}$. In these scenarios, the transfer function $G_{od}$ may allow significant energy to reach the feed-forward microphone 102, and instability or oscillation may result.

The external sound received at the feedback microphone 104 may be modelled as differing from that received at the feed-forward microphone 102 by a transfer function-like relationship expressed as $N_{so}$. This is closely related to the passive transmission loss of the earbud.

Referring again to the summing amplifier 210, the outputs of the first, second, and third digital filters 202, 204, 206 are added at the summing amplifier 210, which produces an output to the acoustic driver 106. The resulting driver signal (d) is also output to the off-head state monitoring circuit 208. The relationship between driver voltage of the driver 106, i.e., the signal output from the summing amplifier 210, to the feedback microphone signal (s), e.g., output voltage, of the feedback microphone 104 is shown as transfer function ($G_{sd}$).

The acoustic transfer functions $G_{sd}$ and $N_{so}$ both change substantially when the device is removed from the ear. In general, $G_{sd}$ decreases in magnitude at low frequencies, and $N_{so}$ increases in magnitude at high frequencies. Although tracking these changes in $G_{sd}$ and $N_{so}$ would aid in off-head detection, these transfer functions cannot be measured in isolation when the feedback filter (Kfb) is turned on and forming a feedback loop. Instead, changes in these transfer functions must be monitored indirectly by observing changes in the behavior of the feedback loop.

For the system shown in FIG. 2, the frequency domain relationship between the feed-forward microphone (o), the audio input (a), and the commanded driver output (d) is mathematically provided in Eq. 1 as follows:

$$d = o\left(\frac{N_{so}K_{fb} + K_{ff}}{1 - G_{sd}K_{fb}}\right) + a\left(\frac{K_{eq}}{1 - G_{sd}K_{fb}}\right) \quad \text{Eq. 1}$$

Because this equation contains the acoustic transfer functions $G_{sd}$ and $N_{so}$, the relationship between the driver signal and the two inputs (o) and (a) will change when the device is removed from the ear. Thus, by using the inputs (o) and (a) measured by the signal monitoring circuit 220, the known filters K, and a model 222 of acoustic transfer functions $G_{sd}$ and $N_{so}$ in the off-head state, Eq. 1 can predict the content of the driver signal (d) in the off-head state. An expected-output computation circuit 221 executes a function according to Eq. 1, and predicts a value of the output signal (d) based on a combination of the audio signal (a) and feed-forward mic signal (o) from the signal monitoring circuit 220, and off-head data, for example, values corresponding to transfer functions (Nso, Gsd) stored in the off-head model 222. If the predicted driver signal is similar to what is actually measured, then an off-head state is confirmed.

FIGS. 3A-3D are graphs illustrating transfer functions between the inputs (o) and (a) and the driver output (d). The transfer functions can be measured in isolation if one of the inputs (o) or (a) is very small relative to the other. These transfer functions are shown for the off-head case (dashed line) and for various in-ear fits (solid lines) with varying acoustical leak. Frequencies where there is the largest difference between in-ear and off-head states range from 60 Hz to 600 Hz, where the feedback loop is most active in this particular device. In-ear and off-head states can most easily be distinguished by observing frequencies in this range.

Figure 3A:
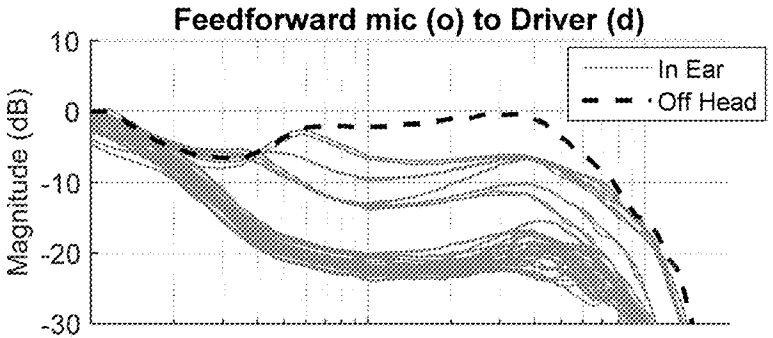
FIGS. 3A-3D are graphs illustrating changes in acoustical transfer functions as a headset transitions from an on-head state to an off-head state.
Figure 3B:
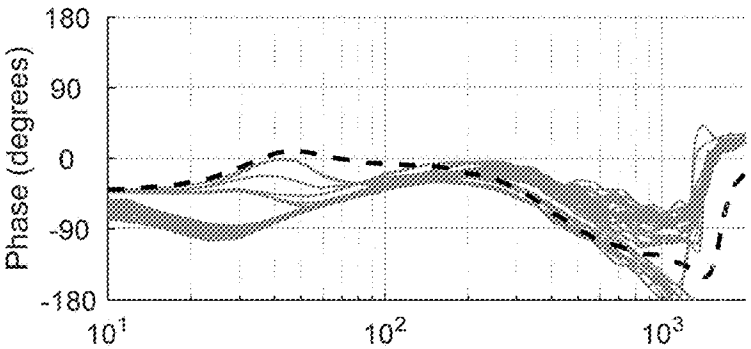
Figure 3C:
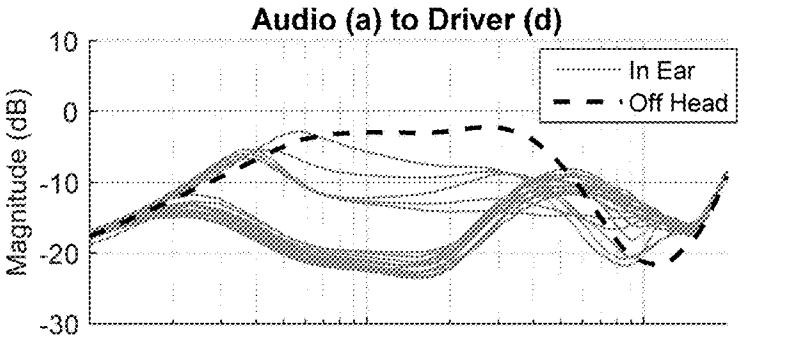
Figure 3D:
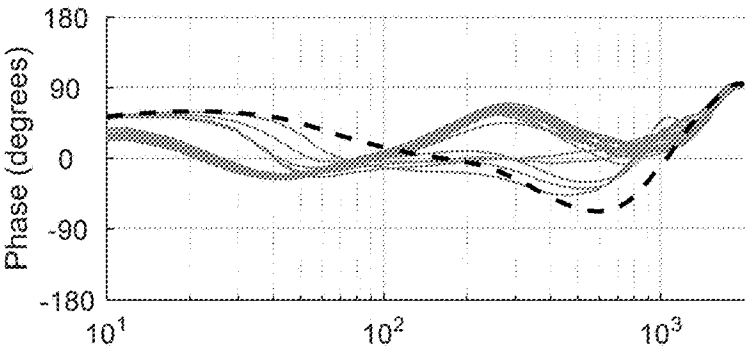

In addition, FIGS. 3A-3D illustrate that the transfer functions from both inputs (o) and (a) to driver (d) generally exhibit similar behavior. As an in-ear headset transitions from a good on-head fit to an off-head state, as shown in FIGS. 3A and 3C, both transfer functions in the two halves of equation 1 increase in magnitude where the feedback ANR loop is active, and as shown in FIGS. 3B and 3D, their corresponding phases generally move in the same direction. As a result, no consideration need be given to the relationship between the two input signals in order to avoid false positive results (described below).

Figure 4:
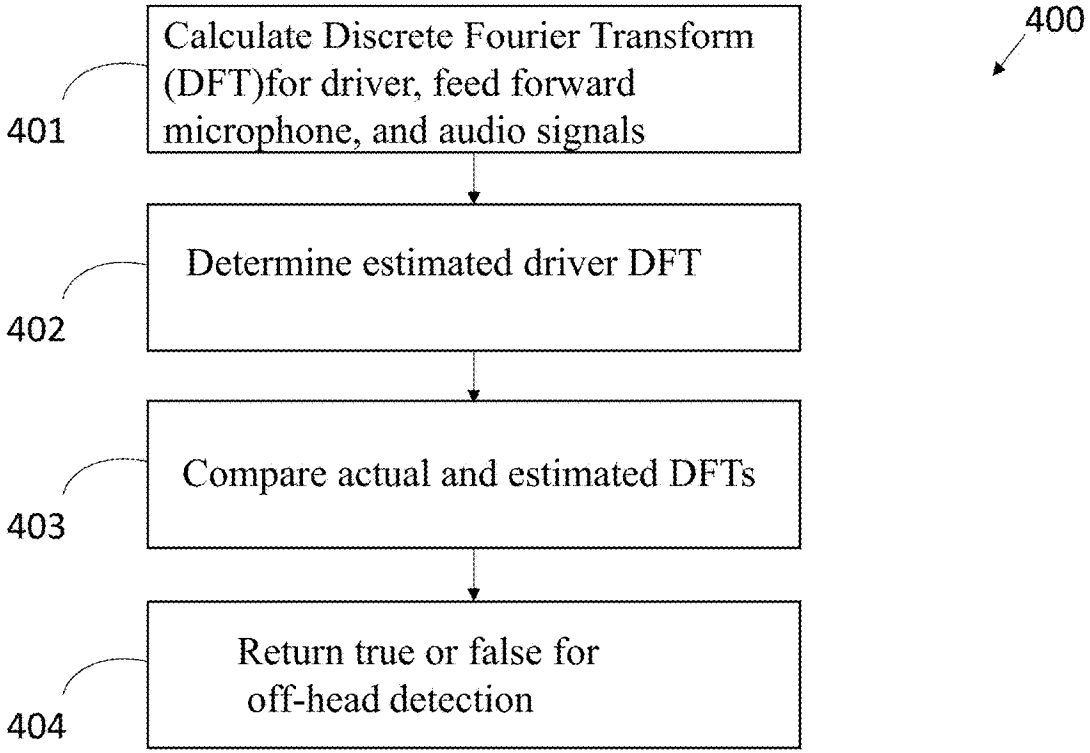
FIG. 4 is a flow diagram of a method for off-head detection, in accordance with some examples.

FIG. 4 is a flow diagram of a method 400 for off-head detection, in accordance with some examples. Some or all of the method 400 may be performed by the controller 110 of the in-ear listening device 10 described with reference to FIGS. 1-3. Steps 401-403 of the method 400 may be derived from an off-head detection algorithm that monitors a system for anomalies or extreme cases in a range between an acceptable fit of the headphone positioned in the wearer's ear and a poor fit where the earbud does not properly seal the ear canal. Accordingly, the controller 110 of FIG. 1 may include a special-purpose computer or subroutine, for example, implementing the off-head detection system 114, which is programmed to perform the off-head detection algorithm.

At step 401, at select frequencies where the feedback ANR loop is active, the discrete Fourier transform (DFT) for each of the driver (d), feed-forward microphone (o), and audio (a) signals are calculated, for example, by signal processing performed at the off-head detection system 114. For example, a frequency range may be between 60-600 Hz referenced above, but not limited thereto. In this example, two select frequencies may include 125 Hz and 250 Hz, but not limited thereto. Other frequency ranges and points may equally apply, depending on the application. In the above example, two frequency points are used to reduce computational complexity.

At step 402, estimated driver signal DFTs are determined at each selected frequency, for example, by multiplying the feed forward (o) and audio (a) DFTs by the transfer functions in Eq. 1, which include the off-head acoustic transfer functions $G_{sd}$ and $N_{so}$ of the model 222 employed at the signal monitoring circuit 220.

At step 403, the measured driver DFTs calculated at step 401 and the estimated driver DFTs calculated at step 402 are compared. At step 404, if the actual and estimated driver DFTs are determined to be within a predetermined range with respect to each other, then off-head detection may return true, or to an off-head state.

As described herein, the system reduces gain to avoid oscillation with respect to off-head detection. In some examples, a hearing assistance system 116 may include a digital signal processor (DSP) that processes the feed-forward microphone signal and/or other external microphone signals parallel to the processing steps described with respect to the figures. The hearing assistance DSP adds gain ("hearing assistance gain") and combines the output with other audio sources, e.g., streaming music, voice prompts, and the like, outputting the audio signal (a) to the ANR circuit 112. The loop formed by transfer function $G_{od}$ and the hearing assistance gain may cause oscillation when the device is removed from the ear, resulting in the gain being reduced when off-head detection occurs.

The foregoing gain reduction can be performed only, for example, at high frequencies (above 1.5 KHz) in the out-loud path, i.e., the amplified external noise that is injected along with streamed audio (a) shown in FIG. 2, since these couple easily to the external microphone (s). Streaming audio and low-frequency out-loud audio can be left intact so that they can continue to be used together as an input to the off-head detection algorithm. The gain reduction occurs in the frequency domain. A compression algorithm at the controller 110 may, for example, constantly adjust gains in individual frequency bands, or limit a maximum gain in the bands prone to oscillation. Other gain adjustment methods are possible and a trivial extension. Once an off-head state is determined, a maximum allowable gain may start to decrease, for example, at a rate of 40 dB/s. If the device 10 has less gain than the maximum allowable gain, then there will be a delay between off-head detection and any noticeable change in gain, adding some protection against false-positives. The gain increase upon re-insertion may function in a similar way.

The following is an example of an implementation of the method 400 illustrated in FIG. 4, and executed at the controller 110 of FIGS. 1 and 2. In some examples, the method 400 is evaluated 32 times per second, but not limited thereto. In this example, the in-ear listening device 10 is initially in the ear and reporting false for off head detection. At 0 seconds, the device 10 is removed from the head. After 0.25 seconds, a reduction of the maximum possible gain at a rate of −40 dB/s begins. After 0.75 seconds, tolerances are reduced, and the system begins to require that off-head conditions be met at one frequency instead of two in order to reduce false-negatives. A 0.5 second delay is introduced to both reduce false-negative data by sampling additional on-head time, and to also allow the user to end a physical interaction within the earbud that might otherwise cause undesirable oscillation to occur due to mechanical perturbation or increase in acoustic Gdo (see FIG. 2) sensitivity, for example, due to close proximity of the user's hand to the earbud. If, during this sequence, an evaluation of method 400 fails to return an off-head state due to the predominance of a noise source, the sequence starts over, and if any gain reduction has occurred, it starts to ramp back up again.

When the device 10 is first reinserted after being off-head for at least 0.75 seconds, the following sequence will occur. At 0 seconds, the device 10 is reinserted. After 0.5 seconds, the maximum possible gain is increased at a rate of 40 dB/s. Tolerances are increased—requiring that off-head conditions be met at two frequencies instead of one in order to reduce false-positives. A 0.25 second delay is introduced before reducing gain upon removing the device. If, during this sequence, an evaluation of method 400 returns an off-head state due to incomplete insertion of the in-ear device, the sequence will start over. The foregoing time and ramp rate data may be subject to change based on typical design considerations such as oscillation sensitivity of earbud acoustics, tolerance for false positives/negatives, computational complexity, and so on.

The response time of an algorithm employed by examples of the off-head detection system when executed presents a trade-off to the rate of false positives where the off-head detection system does not recognize that the headset set for a sufficiently high gain to oscillate is indeed off-head. For example, the system employing the off-head detection algorithm may begin reducing gain 0.25 seconds after removal, i.e., in an off-head state, and gain reduction may occur up to a second, or longer, if the gain is initially high. In this example setting, a false positive rate will depend on earbud fit quality, with an immeasurably small false positive rate for good fits, and a false positive rate of about 1% for very poor fits, i.e., where the earbud does not properly seal the ear canal resulting in "sound leaks." In other examples, the off-head detection system can also tolerate the occasional false-negatives if the user is handling the headset or walking around quickly enough that noise generated from the earbud rubbing against the shirt is mistaken for signs of being on-head. In typical usage scenarios, when the headset is worn on the body but not in the ears, such as draped on the shoulders, it is assumed that the user will use it again soon, so powering down due to non-usage is not important. Battery life can be saved, however, by implementing an auto-power down feature described herein, for example, powering down the device if the user takes it off and sets it on a desktop, where it remains motionless for a predetermined amount of time, for example, several hours.

It is well known that after donning, a poor earbud fit can create poor performance for a hearing device, and that ANR will suffer, for example, in limiting the amount of stable gain applied without oscillation. In cases where the earbud does not properly fit into the user's ear after donning the device, an off-head state may be detected according to the system, for example, described above in FIGS. 1 and 2. The earbud fit can be improved using a combination of off-head detection and information, for example, informational feedback, to the user through a user interface presented at and executed by a personal computing device, thereby improving the performance of the hearing device. Examples of such a user interface include but are not limited to visual feedback of the off-head state to the user via a wirelessly connected application executed at the computing device, an audible prompt (e.g. tone or voice) to the user indicating the off-head state, and so on.

Figure 5:
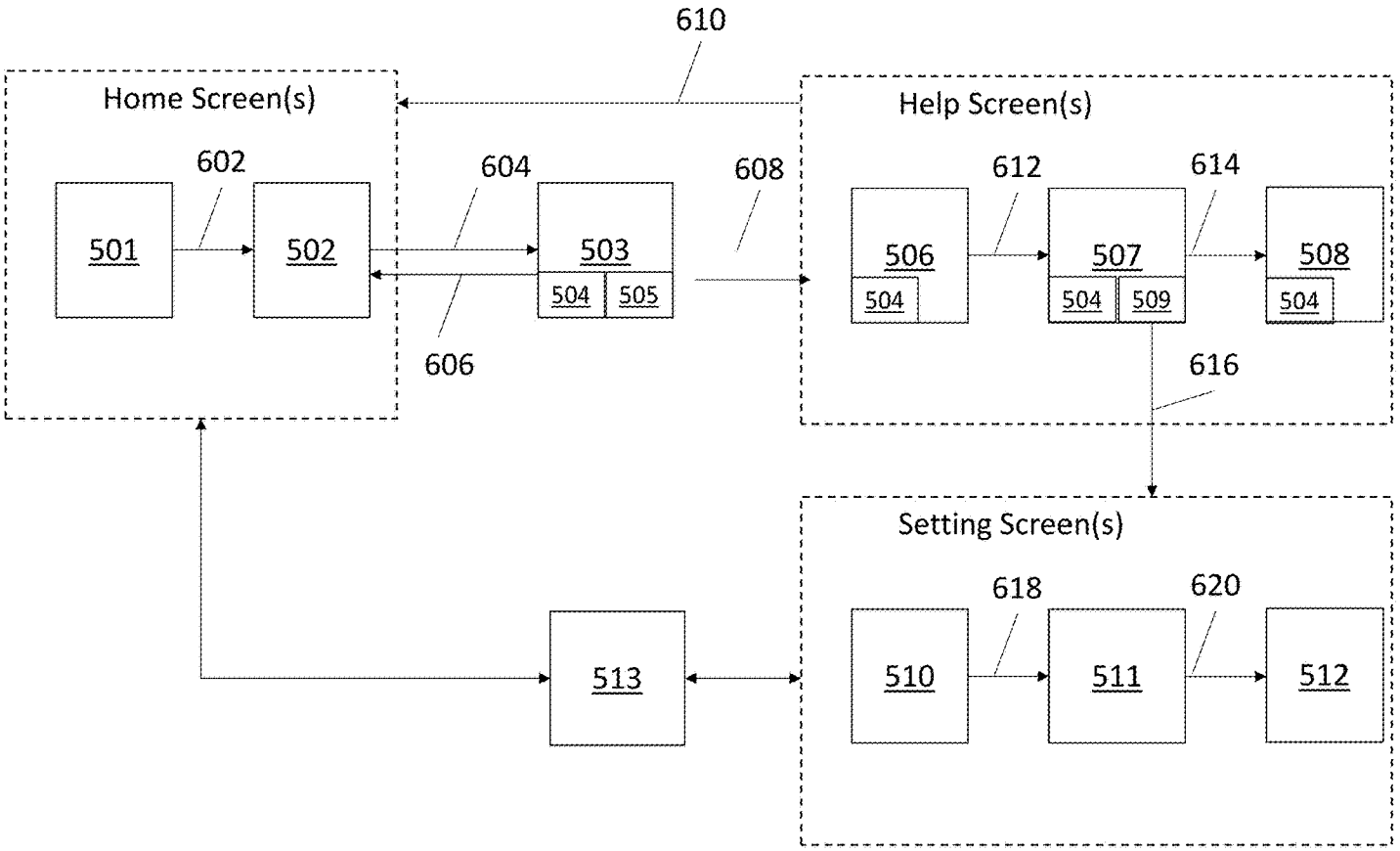
FIG. 5 is a view of a flow diagram of operations performed by a user interface, in accordance with some examples.
Figures 5A, 5B:
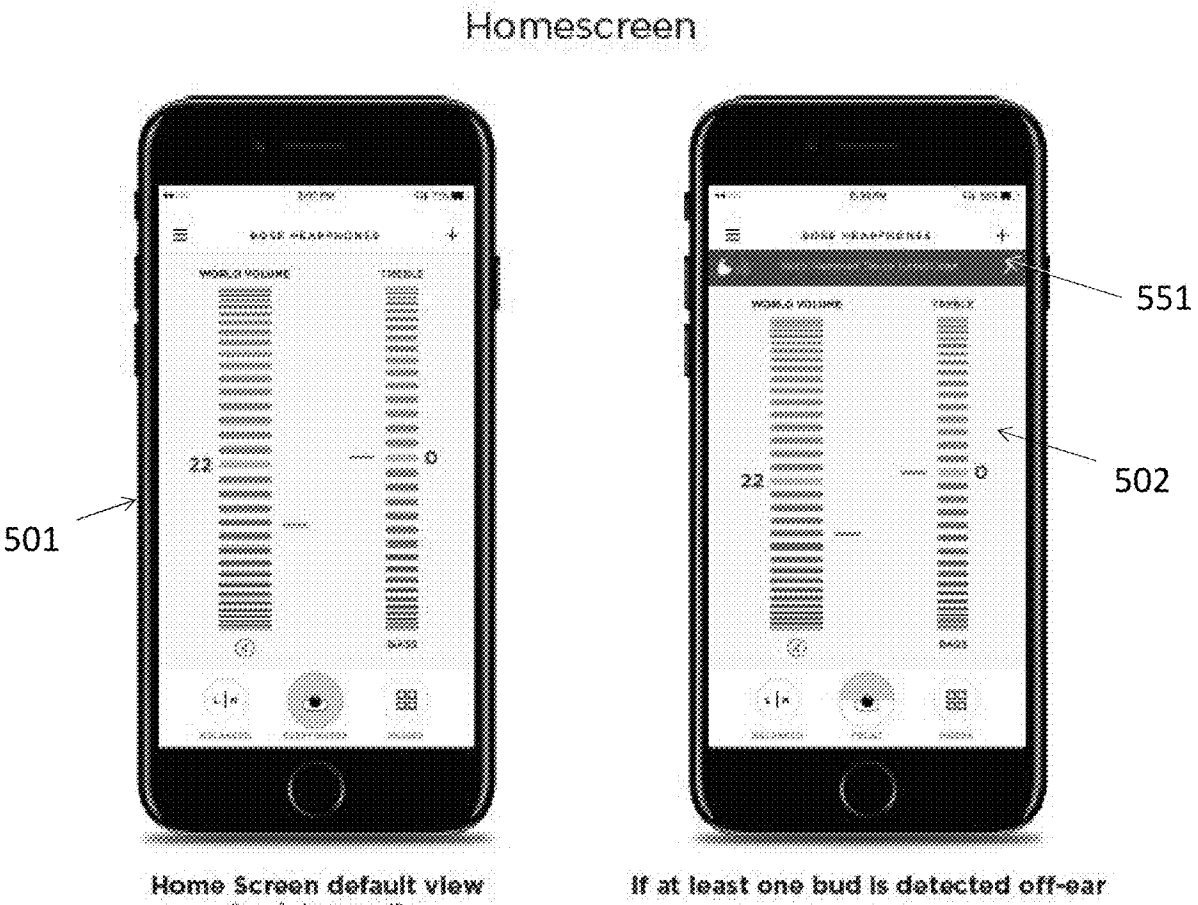
FIGS. 5A-5J are detailed views of the screenshots of the flow diagram of FIG. 5.

An example of a wirelessly connected application, or more specifically, a set of screenshots of a user interface (UI), is illustrated at FIG. 5. Upon an off-head detection, the device may transmit a detection event to the wirelessly connected application 501 (see also FIG. 5A), for example via Bluetooth connection or other electronic communication. For example, a transition from screenshot 501 to screenshot 502 (see also FIG. 5B) may relate to a state transition, for example, when the application detects (602) at least one bud has changed state, for example, transitioned from an in-ear state to an off-ear state. The user interface displays shown in screenshots 501 and 502 may be referred to as a "home screen." Screenshot 503 may be displayed at the user interface in response to the user selecting (604) an alert button or the like at screenshot 502.

Figure 5C:
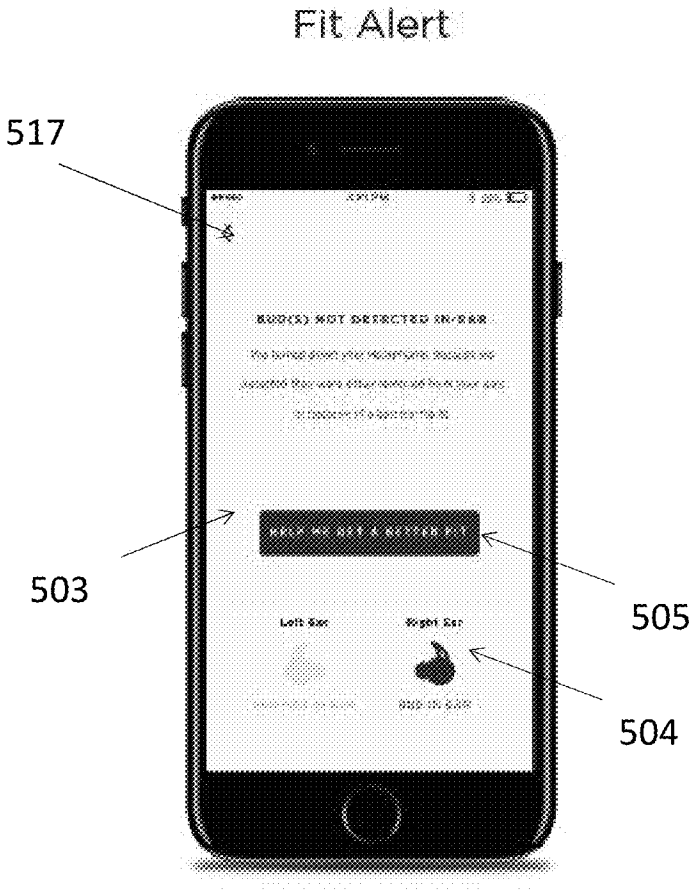

As shown in screenshot 503, a banner 551 may indicate the off-head state for one or more earbuds. In other examples, the user may select e.g., click, the banner 551, which in turn results in a screen change, where a "Help Presents" subscreen 505 (see also FIG. 5C) is displayed whereby the user may receive displayed detail that the quality of a personal hearing device fit may be limiting the performance of the user's hearing device and causing it to appear as off-the-head. In some examples, the user may decide to return (606) to a home screen, e.g., shown in screenshot 501. Here, the user may select an electrically-displayed arrow 517, or icon, button, or the like.

A button, icon, or other subscreen electronic display 504 illustrates a real-time display of the on/off head state, which indicates via color change when an earbud is detected as on- or off-head. This allows the user to improve the acoustic seal of the earbud, for example through a deeper insertion, twisting of the earbud, or selection of an alternative earbud size, until an improved fit results, which drives an on-head detection and change of the indicator 504.

Figures 5D, 5E, 5F:
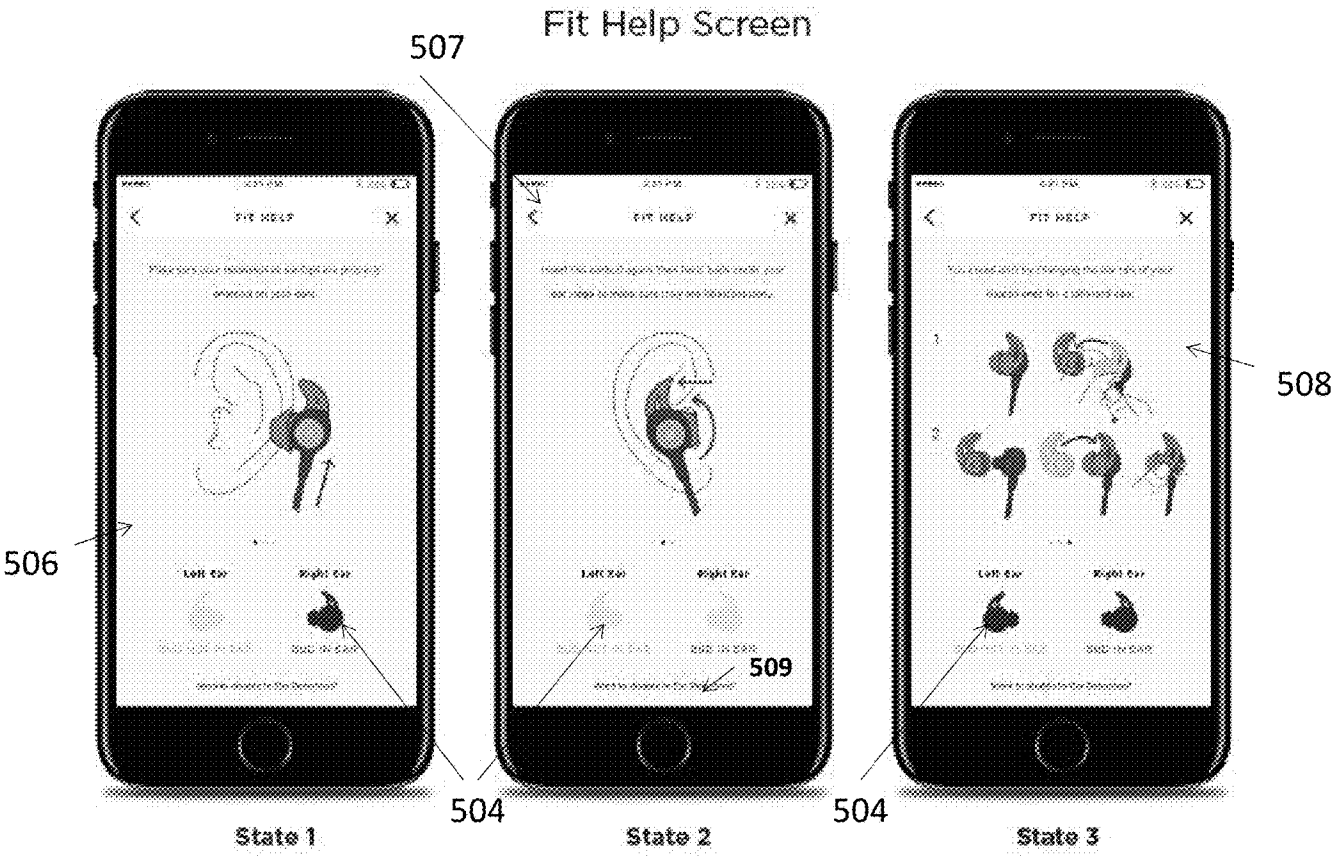

Returning to subscreen 505, when a user selects a button, icon or the like at subscreen 505, further help is accessible (608) at one or more help screens, for example, shown at screenshots 506, 507, and 508, respectively (see also FIGS. 5D, 5E, and 5F). The information within the help screens guide the user through manipulations and alternative earbud selections to improve fit quality. The user is also presented with the opportunity to disable off-head detection via a button or link 509 if desired. In some examples, the user may decide to return (610) to a home screen, e.g., shown in screenshot 501. The user may select between help screens shown in screenshots 506, 507, and 508 by swiping (612, 614), or other transitioning between displayed elements.

When the user selects link 509 at help screenshot 507, one or more settings screens may be displayed, for example, shown at screenshots 510, 511, and 512, respectively.

Figure 5G:
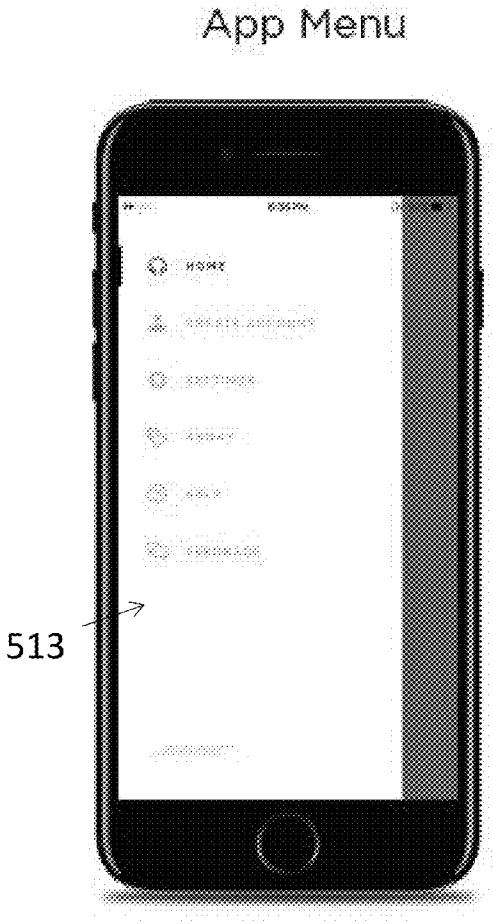
Figures 5H, 5I, 5J:
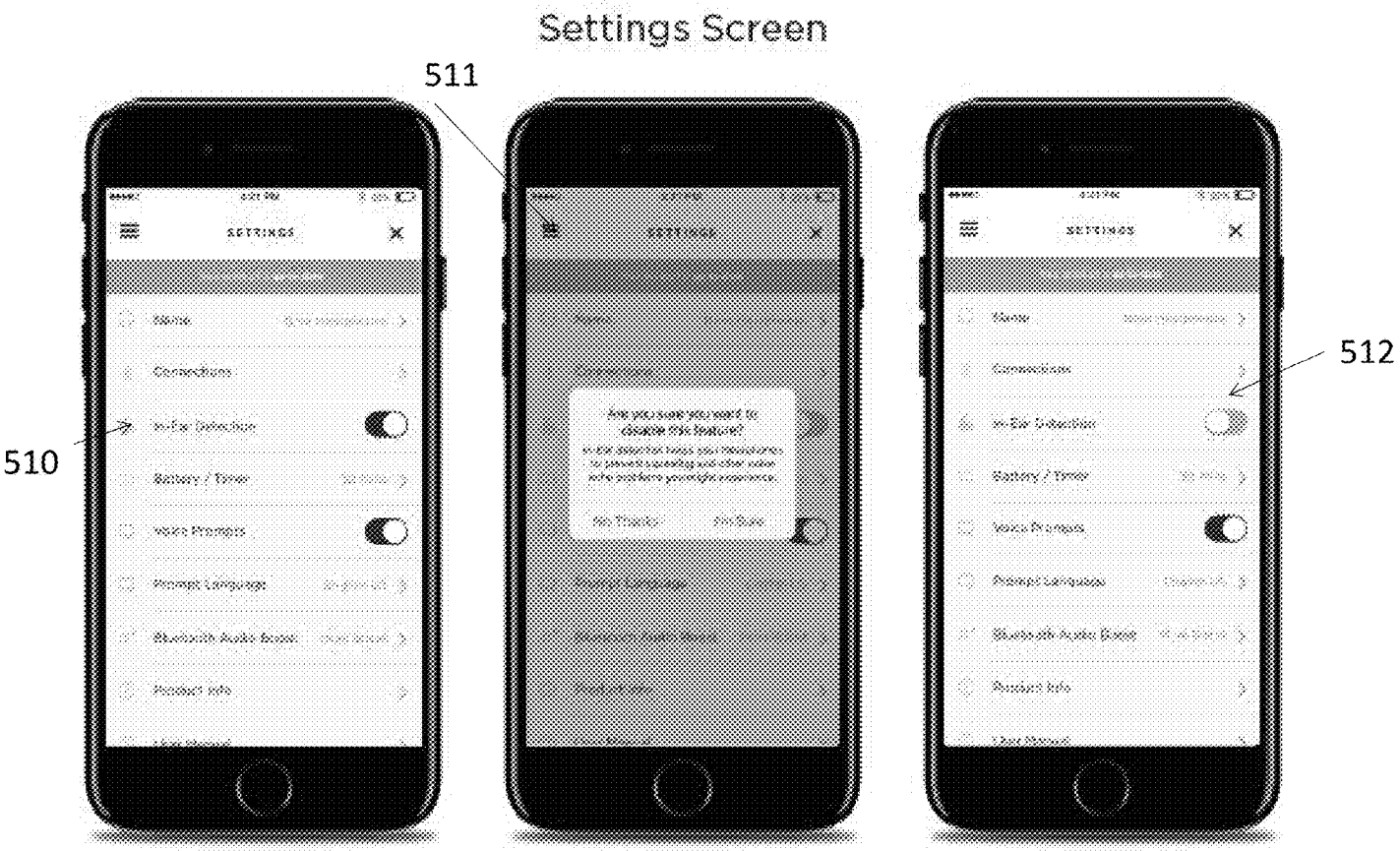

At settings screen shown at screenshot 510 (also shown at FIG. 5H), a user can select (618), swipe, or the like an electrically-displayed arrow 517, or icon, button, or the like to transition to screen shown at screenshot 511 (also shown at FIG. 5I). Similarly, a user can select (620) an electrically-displayed arrow, icon, button, or the like to transition to screen shown at screenshot 512 (also shown at FIG. 5J).

Any of the displayed screens shown in the screenshots of FIGS. 5A-5F, 5H-5J, in particular, a home screen or settings screen, may transition to an application menu shown in screenshot 513 at FIG. 5G. At the application menu, a user can transition to a different screen, for example, a setting screen 510-512.

It is to be understood that the foregoing description is intended to illustrate and not to limit the scope of the invention, which is defined by the scope of the appended claims. Other embodiments are within the scope of the following claims.

What is claimed is:

1. A control system for a listening device, comprising:

a detection system that reconfigures parameters in response to a detection event;

an active noise reduction (ANR) circuit that manages at least a feedback-based noise reduction function; and an off-head monitoring circuit that compares an actual driver output signal and a predicted driver signal to determine the detection event, the detection event including a state transition between an on-head state and an off-head state of the listening device.

2. The control system of claim 1, wherein the ANR circuit generates an anti-noise signal in response to receiving and processing a sound from an acoustic source, the anti-noise signal output to an acoustic driver for canceling ambient noise at an acoustic driver.

3. The control system of claim 1, further comprising a hearing assistance system that combines a gain with an audio signal and outputs a modified audio signal to the ANR circuit.

4. The control system of claim 3, wherein the ANR circuit includes a plurality of digital filters that receive signals detected by a feedback microphone and a feed-forward microphone respectively, and processes the detected feedback and feed-forward microphone signals and the modified audio signal from the hearing assistance system to generate an output signal to an acoustic driver.

5. The control system of claim 1, further comprising a gain reduction system that reduces oscillation when the listening device is removed from an ear.

6. The control system of claim 1, wherein the off-head monitoring circuit detects when the listening device is taken off-head by comparing a current state of the detection system and an expected state of the detection system.

7. The control system of claim 6, wherein the off-head monitoring circuit comprises:

a signal monitoring circuit that measures a feed-forward microphone input and an audio input to the ANR circuit;

an off-head model that processes off-head data produced according to acoustic transfer functions that change in magnitude when the listening device is removed from an ear in the off-head state of the listening device;

an expected-output computation circuit that predicts a value of an output of the ANR circuit based on a combination of the measured feed-forward microphone input, the measured audio input, and values corresponding to the acoustic transfer functions stored in the off-head model; and a comparator that compares a combination of the output of the ANR circuit, the audio input signal, and the feed-forward microphone input to determine the off-head state of the state transition of the listening device.

8. The control system of claim 7, the comparison circuit is constructed and arranged as part of a digital signal processor (DSP) that compares the output of the ANR circuit, the audio input signal, and the feed-forward microphone input, in addition to a feedback microphone input from a feedback microphone to determine the off-head state of the listening device.

9. The control system of claim 7, wherein the expected-output computation circuit predicts the value of the output signal based on a combination of the audio signal and the feed-forward microphone signal and the off-head data, wherein when a result of the comparison confirms that the predicted driver signal is similar to a measured signal, then the off-head state is confirmed.

10. A system for performing a fit quality assessment, comprising:

an input device that receives an audio signal, a feed-forward microphone signal, and a driver output signal;

an expected-output computation circuit that predicts a value of the driver output signal based on a combination of the audio signal, the feed-forward microphone signal, and off-head data produced according to acoustic transfer functions that change in magnitude when the headset is removed from an ear in an off-head state of the headset;

a comparison circuit that compares the driver output signal, the audio signal, and the feed-forward microphone signals to determine the off-head state of the headset; and a display that displays informational feedback regarding the off-head state.

11. The system of claim 10, wherein the input device comprises an active noise reduction (ANR) circuit that processes a feedback microphone signal.

12. The system of claim 11, wherein the comparison circuit is constructed and arranged as part of a digital signal processor (DSP) that compares the driver output signal, the audio signal, the feedback microphone signal and the feed-forward microphone signal to determine the off-head state of the headset.

13. The system of claim 10, further comprising a gain reduction system that reduces oscillation when the headset is removed from an ear.

14. The system of claim 10, wherein when the off-head state is confirmed, the headset is configured to automatically power-down after expiration of a timer.

15. The system of claim 10, wherein when an off-head state is confirmed, the headset is configured to automatically transition into a different power state after expiration of a timer.

16. The system of claim 10, wherein the display comprises a use-interface to display an indication of the off-head state of the headset.

17. A system for off-head detection, comprising:

a detection system that performs signal processing on a feedforward microphone signal and an input audio signal to determine an estimated discrete transform of a driver output signal; a processor of the detection system that determines an actual discrete transform of the driver output signal; and a comparison circuit that compares the actual discrete transform and the estimated discrete transform and determines an off-head state when the actual discrete transform and the estimated discrete transform are determined to be sufficiently similar.

18. The system of claim 16, wherein the detection system calculates a discrete Fourier transform (DFT) for each of the driver output signal, feed-forward microphone signal, and audio signal at select frequencies where a feedback ANR loop is active.

* * * * *